United States Patent [19]

Lee, Jr. et al.

[11] Patent Number: 4,589,270

[45] Date of Patent: May 20, 1986

[54] HYDRAULIC BOTTOM FORMER

[75] Inventors: Harry W. Lee, Jr., Chesterfield County; Joseph W. Wallace, Henrico County, both of Va.

[73] Assignee: Reynolds Metals Company, Richmond, Va.

[21] Appl. No.: 728,816

[22] Filed: Apr. 30, 1985

[51] Int. Cl.[4] ..... B21D 22/00

[52] U.S. Cl. ..... 72/348; 72/347; 72/349

[58] Field of Search ..... 72/347–349

[56] References Cited

U.S. PATENT DOCUMENTS

| | | | |
|---|---|---|---|
| 3,270,544 | 9/1966 | Maeder et al. | 72/346 |
| 3,760,751 | 9/1973 | Dunn et al. | 113/120 H |
| 3,771,345 | 11/1973 | Paramonoff | 72/349 |
| 4,289,014 | 9/1981 | Maeder | 72/348 |
| 4,372,143 | 2/1983 | Elert et al. | 72/343 |
| 4,499,750 | 2/1985 | Gerber | 72/349 |

*Primary Examiner*—Leon Gilden

*Attorney, Agent, or Firm*—Alan T. McDonald

[57] ABSTRACT

An improved bottom former for a draw and iron can-making apparatus is disclosed. The improved bottom former includes a hydraulically pressurized base-forming die unit. This die unit provides increased pressure and improved results, as compared with conventional bottom formers, especially with regard to large diameter can bodies.

3 Claims, 1 Drawing Figure

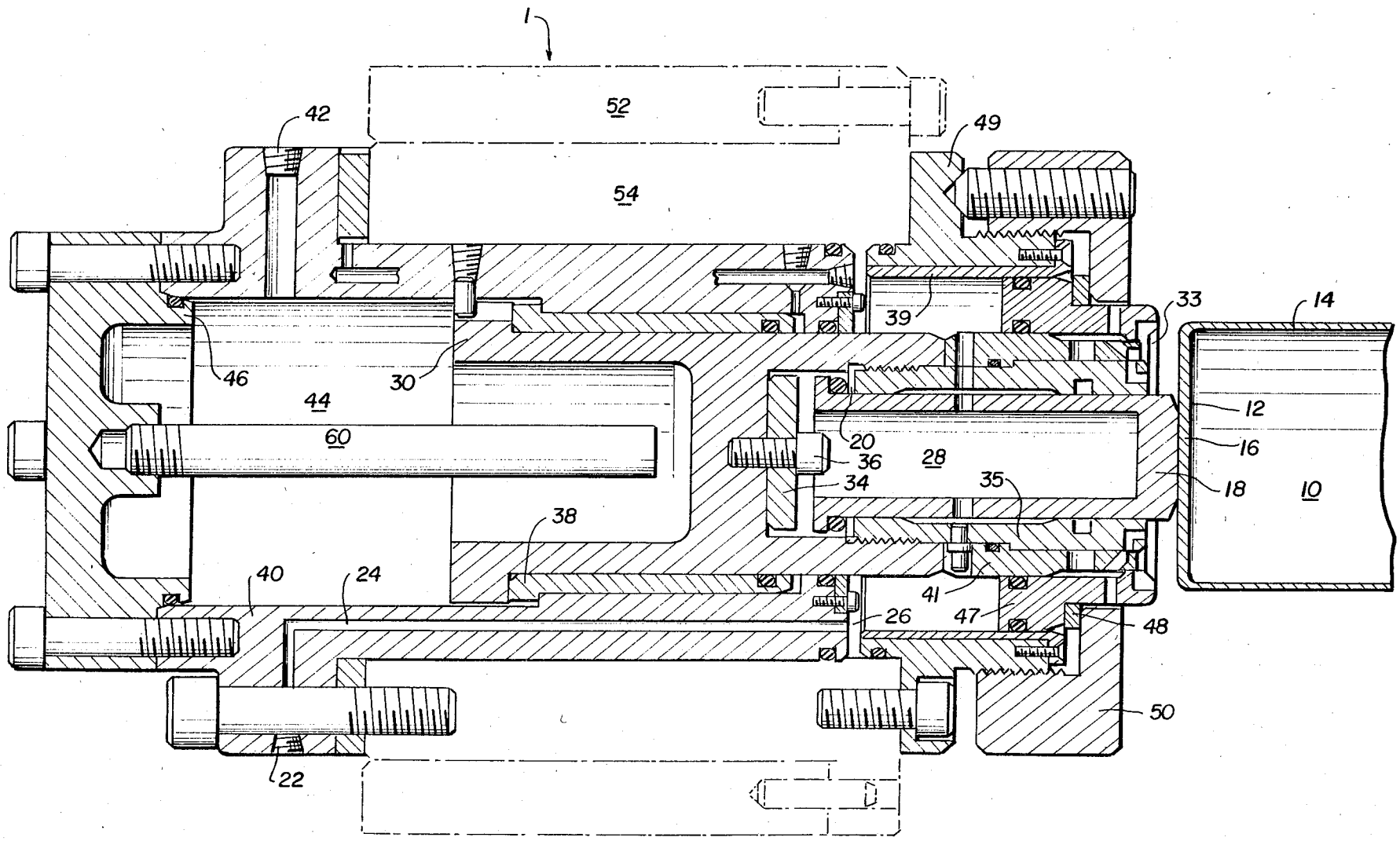
14
10
12
16
18
33
48
50
49
35
47
41
28
39
26
20
36
34
52
54
38
1
30
24
60
44
42
22
40
46

HYDRAULIC BOTTOM FORMER

BACKGROUND OF THE INVENTION

Metallic can bodies, typically formed of aluminum or steel alloys, are now routinely formed by drawing and ironing a circular blank of sheet metal into a cylindrical can body.

Especially in the case of aluminum alloy can bodies, in which the thinned side walls provide insufficient structural strength for the can, the can bottom closing structure is of vital importance to can quality. There are numerous patents in the literature concerning bottom structures for can bodies.

The bottom structure of the can body is formed at the end of the draw and iron cycle. A punch carrying the can body through the draw and iron dies includes at the end thereof a die structure corresponding to the bottom structure to be formed in the can bottom. At the end of the stroke carrying the can body through the press, the can bottom and punch strike against a bottom former. This bottom former also includes die structure which, with the die structure of the punch, forms the bottom structure in the can body. The bottom former plug is mounted so as to provide a resilient, yet firm, pressure between the can body and the bottom former at their point of contact.

Traditionally, bottom former have been mounted to provide resilient force by mounting either against a rubber back-up pad or against a pneumatic pressure cylinder. However, the recent advent of substantially increased diameter draw and iron can bodies has resulted in a need for higher pressure levels between the bottom former and the punch in order to successfully form bottom structures on these larger cans without wrinkling of the metal in the can.

It is thus the primary objective of the present invention to provide a bottom former for a draw and iron can-making press which provides increased force against the can body and punch when the can body and punch contact the bottom former, while maintaining a resiliency in the bottom former.

THE PRESENT INVENTION

By means of the present invention, this desired result is obtained. The bottom former of the present invention comprises a bottom-forming die set which is mounted to provide a resilient force against the can bottom and punch by means of hydraulic back-up cylinder for the die set. The resulting structure provides forces far in excess of those possible with either rubber pad or pneumatic systems of commercially acceptable size.

BRIEF DESCRIPTION OF THE DRAWING

The bottom former of the present invention will be more fully described with reference to the FIGURE, which is a cross-sectional view of the bottom former of the present invention.

DETAILED DESCRIPTION OF THE PREFERRED EMBODIMENT

Turning now to the FIGURE, a punch 10 having an end die structure 12 carries can body 14 having a bottom surface 16 thereon. As illustrated, the punch 10 has brought the can body 14 through a series of draw and iron dies, as is customary in the art. The can bottom 16 has just come into contact with a stripper pin 18 of bottom former 1. Stripper pin 18 is shown in its most forward position, with its position being maintained by its contact against stop 20. Stripper 18 is pneumatically held against stop 20 by pneumatic pressure. Compressed air, typically at a pressure of approximately 100 psig enters the bottom former 1 through inlet 22 and passes along passageways 24 and 26 to chamber 28. The air pressure within chamber 28 forces stripper pin 18 to the position shown in the FIGURE. Stop 20 is mounted on base form piston 30.

As punch 10 continues advancing, overcoming the air pressure within cylinder 28, stripper pin 18 retracts, eventually reaching stop 34. Stop 34 has its thickness selected for a given can bottom design and thus for the ultimate retracted position of stripper pin 18, and is mounted by means of bolt 36 to base form piston 30. With the further advance of punch 10, the bottom 16 of can body 14 now contacts the die members 33 and 35 of bottom former 1. Since stripper pin 18 has been retracted its full distance, and punch 10 has a degree of overtravel beyond that of stripper pin 18, punch 10 attempts to force stripper pin 18, and die member ring 35 and die member 41 rearwardly. At this point, the hydraulic mechanism of the present invention comes into play.

Base form piston 30 is mounted within bearing 38, which bearing is in turn mounted within a base form cylinder 40. Inlet 42 within base form cylinder 40 is connected to a source of hydraulic fluid under pressure, such as a low modulus silicone fluid, or other hydraulic fluid, under a pressure of, for example, up to about 750 psig. This hydraulic fluid is held within chamber 44 formed by base form cylinder 40, base form piston 30 and cylinder cap 46, resulting in a force of up to about 9,500 pounds acting against punch 10 and can bottom 16. This high force acting upon the can bottom 16 assures that the bottom structure formed in the bottom 16 by dies 12 and 34 will occur.

The force of punch 10 is sufficient to overcome the force of base form piston 30, forcing base form piston 30 and attached die members 33 and 35 rearwardly for a slight distance in the order of 1/16 of an inch, ending the overtravel of punch 10.

As punch 10 retracts, the hydraulic pressure on base form piston 30 forces it forward, until base form piston 30 reaches bearing 38. As the punch 10 continues its rearward travel, the air pressure within chamber 28 forces stripper pin 18 forward, stripping can body 14 away from dies 33 and 35.

The stripper pin 18, die members 33 and 35, and their associated tooling are held within positioning ring 50. The entire bottom former 1 is mounted to the frame 52 of the press by means of support bracket 54.

A piston stop 60 is employed to limit travel of base form piston 30 when no hydraulic pressure is applied. This only occurs during installation and shutdown of the unit and thus, this stop 60 plays no part of the system during normal operations.

As can be seen in the FIGURES, numerous bolts, seals and pressure relief lines are present in the apparatus. Their utilities are typical, and need not be explained further.

From the foregoing, it is clear that the present invention provides a simple, yet effective means for supplying a large pressure against a can bottom in a bottom forming operation. While the invention has been described with reference to a certain specific embodiment thereof, it is not intended to be so limited thereby, except as set forth in the accompanying claims.

We claim:

1. In a draw and iron press for forming a can body including means for forming a bottom structure on said can body, said means for forming a bottom structure comprising a punch over which said can body is carried having a first die structure, a bottom former having a die structure which mates with said first die structure when said can body is contacted between said punch and said bottom former under pressure and means for resiliently mounting said bottom former for contact with said can body under pressure the improvement wherein said means for resilient mounting comprises a hydraulic cylinder connected to a source of hydraulic fluid under pressure up to 750 PSIG to provide a force up to 9500 pounds to said bottom former sufficient to permit said bottom structure to be formed without wrinkling.

2. The apparatus of claim 1 wherein said bottom former further comprises a pneumatically resilient stripper pin.

3. The apparatus of claim 1 wherein said hydraulic fluid comprises a low modulus silicone fluid.

* * * * *